US007337835B2

(12) United States Patent
Nigam

(10) Patent No.: US 7,337,835 B2
(45) Date of Patent: Mar. 4, 2008

(54) BAFFLE AND TUBE FOR A HEAT EXCHANGER

(75) Inventor: Krishna Deo Prasad Nigam, New Delhi (IN)

(73) Assignee: Indian Institute of Technology Delhi, New Delphi (IN)

( * ) Notice: Subject to any disclaimer, the term of this patent is extended or adjusted under 35 U.S.C. 154(b) by 0 days.

(21) Appl. No.: 11/146,913

(22) Filed: Jun. 7, 2005

(65) Prior Publication Data

US 2006/0162912 A1 Jul. 27, 2006

(30) Foreign Application Priority Data

Jan. 25, 2005 (IN) ..... 159/2005

(51) Int. Cl.
*F28D 7/02* (2006.01)

(52) U.S. Cl. ..... 165/163; 165/159

(58) Field of Classification Search ..... 165/159, 165/160, 162, 163
See application file for complete search history.

(56) References Cited

U.S. PATENT DOCUMENTS 2,141,899 A * 12/1938 Bennett ..... 165/110
2,508,247 A * 5/1950 Giauque ..... 165/163
2,530,648 A * 11/1950 Cahenzli et al. ..... 62/513
2,693,346 A * 11/1954 Petersen ..... 165/160
3,335,790 A * 8/1967 Aranyi et al. ..... 165/109.1
3,338,301 A * 8/1967 Romanos ..... 165/145
3,854,530 A * 12/1974 Jouet et al. ..... 165/163
4,107,410 A * 8/1978 Toekes ..... 165/163
4,273,074 A * 6/1981 Kuhlmann ..... 165/163
4,462,463 A * 7/1984 Gorham, Jr. ..... 165/140
4,557,323 A * 12/1985 Hardy et al. ..... 165/163
4,895,203 A 1/1990 McLaren
5,159,976 A * 11/1992 Virtue ..... 165/144
5,379,832 A 1/1995 Dempsey
5,832,739 A * 11/1998 Bacchus ..... 62/310
6,823,668 B2 * 11/2004 Endoh et al. ..... 60/320

OTHER PUBLICATIONS

Kumar, V. et al. "Numerical Simulation of Steady Flow Fields in Coiled Flow Inverter" *International Journal of Heat and Mass Transfer* (2005) vol. 48, pp. 4811-4828.
Saxena, A.K. "Coiled Configuration for Flow Inversion and Its Effects on Residence Time Distribution" *AICHE Journal* (1984) vol. 30, No. 3, pp. 363-368.
Yang, G., et al., "Turbulent forced convection in a helicoidal pipe with substantial pitch", *International Journal of Heat and Mass Transfer*, vol. 39, No. 10, pp. 2015-2022, 1996.

(Continued)

*Primary Examiner*—Teresa J. Walberg
(74) *Attorney, Agent, or Firm*—Ladas & Parry

(57) ABSTRACT

The present invention relates to a heat exchanger for transferring heat from one fluid to another fluid, comprising a plurality of metallic tube continuously formed into four discrete helically wound coils, each coil having at least four turns, the coils being spatially placed such that axis of all the four helical coils of each bank are substantially in one common plane, the axis of each helical coil is at an angle of 90° to the adjacent helical coil, wherein number of banks is from 2 to 10 and ratio of diameter of the helical coil to the diameter of the tube is at least 10:1.

14 Claims, 9 Drawing Sheets

OTHER PUBLICATIONS

Figure 1:
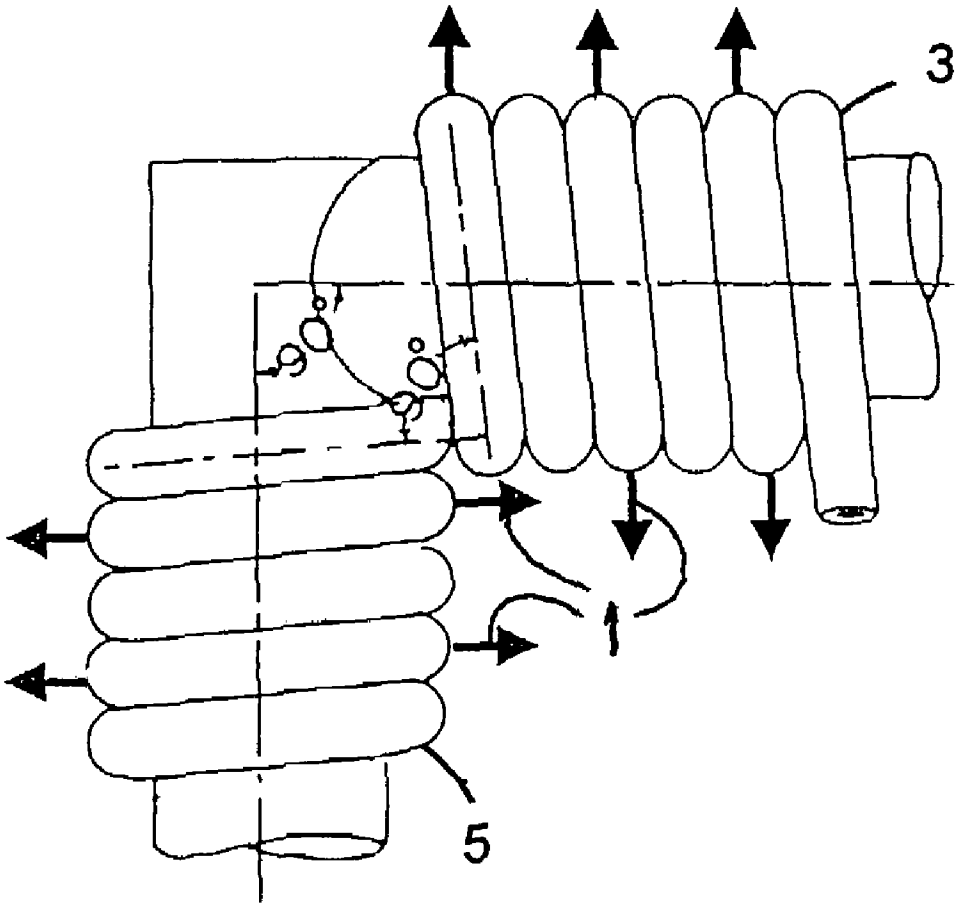

Saxena, Alok K., et al. "Axial Dispersion in Laminar Flow of Polymer Solutions through Coiled Tubes", *Journal of Applied Polymer Science*, vol. 26, pp. 3475-3486, 1981.
Mokrani, A., et al. "The effects of chaotic advection on heat transfer", *International Journal of Heat and Mass Transfer*, vol. 40, No. 13, pp. 3089-3104, 1997.
Castelain, C., et al. "Experimental and numerical characterisation of mixing in a steady spatially chaotic flow by means of residence time distribution measurements". *International Journal of Heat and Mass Transfer* 43, pp. 3687-3700, 2000.
Lemenand, Thierry, et al. "A thermal model for prediction of the Nusselt number in a pipe with chaotic flow", *Applied Thermal Engineering* 22, pp. 1717-1730, 2002.
Nigam, K. D. P, et al. "Transient Behavior of a Non-Ideal Tubular Reactor", The Canadian Journal of Chemical Engineering, vol. 54, pp. 203-208, 1976.
Patent Abstract of JP 52-145854 May 12, 1977.
Patent Abstract of JP 54-097859 Feb. 8, 1979.
Patent Abstract of JP 03-156293 Apr. 7, 1991.
Dean, W.R., "Note on the Motion of Fluid in a Curved Pipe", *Philosophical Magazine and Journal of Science*, iv pp. 208-223, 1927.
Dean, W. R., "The Stream-line Motion of Fluid in a Curved Pipe", *Philosophical Magazine and Journal of Science*, vol. 5, No. 30, pp. 673-695, Apr. 1928.
"On RTD for laminar flow in helical coils" *Chemical Engineering Science*, vol. 34, pp. 425-426, 1979.
"Consecutive reactions in a non-ideal tubular reactor", *Chemical Engineering Science*, vol. 32, pp. 1119-1121, 1977.
"Influence of curvature and pulsations on laminar dispersion", *Chemical Engineering Science*, vol. 31, pp. 835-837, 1976.
Dravid, A. N., et al., "Effect of a Secondary Fluid Motion on Laminar Flow Heat Transfer in Helically Coiled Tubes", AichE Journal, vol. 17, No. 5, pp. 1114-1122, Sep. 1971.
Guo, Liejin, et al., "Transient convective heat transfer in a helical coiled tube with pulsatile fully developed turbulent flow", *International Journal of Heat and Mass Transfer* 41, pp. 2867-2875, 1998.
Guo, Lie-jin, et al., "Transient convective heat transfer of steam-water two-phase flow in a helical tube under pressure drop type oscillations", *International Journal of Heat and Mass Transfer* 45, pp. 533-542, 2002.
Akiyama, Mitsunobu., et al., "Laminar Forced Convection Heat Transfer in Curved Pipes with Uniform Wall Temperature", *International Journal of Heat and Mass Transfer*, vol. 15, pp. 1426-1431, 1972.
Tyagi, V. P., et al. "An Analysis of Steady Fully Developed Heat Transfer in Laminar Flow with Viscous Dissipation in a Curved Circular Duct", *International Journal of Heat and Mass Transfer*, vol. 18, pp. 69-78, 1975.
Acharya, Narasimha, et al., "Thermal entrance length and Nusselt numbers in coiled tubes", *International Journal of Heat and Mass Transfer*, vol. 37, No. 2, pp. 336-340, 1994.
Acharya, Narasimha, et al., "Analysis of heat transfer enhancement in coiled-tube heat exchangers", *International Journal of Heat and Mass Transfer* 44, pp. 3189-3199, 2001.
Zheng, B, et al., "Combined laminar forced convection and thermal radiation in a helical pipe", *International Journal of Heat and Mass Transfer* 43, pp. 1067-1078, 2000.

* cited by examiner

BAFFLE AND TUBE FOR A HEAT EXCHANGER

The present invention relates to a heat transfer apparatus for transferring heat from one fluid to another and the process for achieving high efficiency in heat transfer using the same, where the fluids are separated by a solid wall to avoid inter-mixing. Heat exchangers are commonly used in a wide variety of industrial, chemical, and electronics processes to transfer energy and provide required heating or cooling. They are widely used in refrigeration, air conditioning, space heating, power production, and chemical processing.

BACKGROUND OF THE INVENTION

There are several types of heat exchanger:

Recuperative type, in which fluids exchange heat on either side of a dividing wall Regenerative type, in which hot and cold fluids occupy the same space containing a matrix of material that works alternatively as a sink or source for heat flow Evaporative type, such as cooling tower in which a liquid is cooled evaporatively in the same space as coolant.

The recuperative type of heat exchanger, which is the most common in practice, may be designed depending on their flow arrangement. In parallel-flow heat exhangers, the two fluids enter the exchanger at the same end, and travel in parallel to one another to the other side. In counterflow heat exchangers, which are often more efficient, the fluids enter the exchanger from opposite ends. In a cross-flow heat exchanger, the fluids travel roughly perpendicular to one another through the exchanger.

The most basic and the most common type of heat exchanger construction is the tube and shell. This type of heat exchanger consists of a set of tubes in a container called a shell. The fluid flowing inside the tubes is called the tube side fluid and the fluid flowing on the outside of the tubes is the shell side fluid. At the ends of the tubes, the tube side fluid is separated from the shell side fluid by the tube sheet(s). The tubes are rolled and press-fitted or welded into the tube sheet to provide a leak tight seal. In systems where the two fluids are at vastly different pressures, the higher-pressure fluid is typically directed through the tubes and the lower pressure fluid is circulated on the shell side. This is due to economy, because the heat exchanger tubes can be made to withstand higher pressures than the shell of the heat exchanger for a much lower cost. The support plates act as baffles to direct the flow of fluid within the shell.

While shell and tube heat exchanger are widely in use, they are being replaced by new exchangers as:

They are generally large and heavy

Require generous space for mounting.

Lower heat transfer coefficients

Another type of heat exchangers widely used are heat exchangers in which heating elements are formed from straight (uncoiled) segments of round or square heating cable. Helical coil heat exchangers offer distinct advantages, such as improved thermal efficiency, compactness, easy maintenance and lower installed cost. When an application requires equipment suitable for high operating pressure and/or extreme temperature gradients, a helical coil unit is considered. The exchangers also are suitable for less demanding applications, such as heat recovery, condensing, boiling and basic heat exchange.

Although various configurations are available, the basic and most common design consists of a series of stacked helically coiled tubes. The tube ends are connected to manifolds, which act as fluid entry and exit locations. The tube bundle is constructed of a number of tubes stacked atop each other, and the entire bundle is placed inside a casing, or shell. To effectively optimize thermal and hydraulic requirements, the number of tubes (coils) along with their spacing and length may be varied. This allows a design to meet the thermal and hydrodynamic requirements of both the casing and tube side fluids, so users can select a unit that matches their application's thermal demand and hydraulic limitations.

As with any heat exchanger, the flow rate, allowable pressure, physical properties of the fluid, and construction material control final design. High film coefficients are achieved on both the coil and casing side. The helical flow path imparts higher shear rates and turbulence at a given pressure drop, which can result in film coefficients up to 40% higher than those achieved with many comparable shell and tube units. The spiral pattern also promotes turbulence, leading to increased heat transfer rates. In addition, there are no baffles or dead spaces that lead to inefficiencies commonly found in other types of shell and tube exchangers. The net result is a Helical coil Heat Exchanger that is up to 40% more efficient than a standard shell and tube.

A helical coil heat exchanger is easy to maintain. The casing of the unit can be removed without disturbing any of the piping connections. Once the casing is removed, the entire tube bundle is exposed for inspection. With the casing removed, the shell side of the unit can easily be cleaned in place.

Originally built for use in boiler sample cooling over 60 years ago, there are thousands of helical coil heat exchangers being used today in hundreds of services. Many units have been in operation for well over 40 years. The service life varies with the application, but its many features add to its reliability when compared to a shell and tube exchanger.

No gaskets are required for the tube side of the helical coil heat exchanger. Aggressive fluids are often placed tube side for this reason. No gaskets on the tube side will minimize the chance of leakage.

The spring-like coil of the helical coil heat exchanger reduces stresses caused by thermal expansion of the tube material.

Helical coil heat exchanger can do the job in a fraction of the space required by typical straight shell and tube exchangers. With higher heat transfer efficiencies, the surface area required is normally less than a straight shell and tube. Smaller surface requirements, and the coiled tube design result in a very compact unit. Access space required for maintenance or inspection is very small compared to straight shell and tube exchangers. The only space required for a helical coil heat exchanger is to remove the casing, which allows inspection of both the entire tube bundle and shell side of the exchanger. One can mount a helical coil heat exchanger on columns, nozzles, walls, ceilings, or in-line; and require no support.

Careful selection of the helical coil heat exchanger can accommodate low flow rates while maintaining reasonable velocities.

High (or low) temperature fluids will cause the tube material to expand (or contract). This thermal expansion creates high stresses at the tube-to-tube sheet joints of standard straight shell and tube type units. The helical coil heat exchanger, with its spring-like coils, allows movement of the coil within the bundle. This feature allows the heat exchanger to easily withstand temperature differences of over 500 degrees F. between fluids. Cyclic operation and extreme temperatures are easily handled. Helical coil heat exchanger can be built to accommodate up to 15,000 psig design pressures. The helical coil heat exchanger is capable of thermosiphon when mounted in the correct orientation.

PRIOR ART

Japanese patent JP2003156293 has a plurality of cylindrical bulkhead pipes having annulus spaces inside and both ends parts of which are closed by pipe walls are concentrically arranged with intervals between each other in a drum of the heat exchanger tubes are arranged in the annulus spaces of the cylindrical bulkhead pipes, the high temperature thermal catalyst is made to circulate in the heat exchanger drum through clearances of a plurality of the cylindrical bulkhead pipes, the low temperature thermal is made to circulate inside of the each of the helical coil type heat exchanger tubes, the intermediate thermal medium chemically inactive against both of the low temperature thermal medium and the low temperature thermal medium and excellent in heat exchanging performance is made to circulate inside each of the cylindrical bulkhead pipes.

Another Japanese Patent JP305976 provides a heat exchanger equipped with spiral heat exchanger tubes inside an outer cylinder and connecting pipes which are connected with ends of the heat exchanger tubes at gentle angles of inclination with the axis of the outer cylinder. The connecting pipes have no bends as sharp as right angle or an angle in its vicinity but have gentle bends at obtuse angles.

Japanese Patent JP54097859 teaches heating pipes wound in the shape of helical coils about an inner cylinder placed in the center of an upright cylindrical shell. The pipes are wound through a support plate which is fixed at its upper end to the shell and naturally suspended. The cylinder is fixed to the shell at its upper end and naturally suspended, at the lower end of which there is formed a primary fluid outlet port. A heat exchanger chamber is formed of a cylindrical inner wall pipe which is suspended from the top of the shell and a high temperature tube plate is provided to the bottom. An accumulation chamber for a high temperature secondary fluid is formed below the tube plate and is communicated with an outer nozzle.

Multi-layer helical coil heat exchanger of Patent JP52145854 teaches a coil supporting device in a multi-layer helical coil heat exchanger, satisfying such conditions as simplicity to keep coil pitch or positions in radius line and to assemble and disassemble coils, promotion of thermal flowing function, no loss in effective section and so on.

U.S. Pat. No. 4,895,203 teaches a compact highly efficient heat exchanger used to utilize waste heat from a motor vehicle engine cooling system to heat a source of water for use with a shower or the like in a recreational environment. The heat exchanger comprises a hollow cylinder having a cylindrical wall to define an annular space there between. Within the annular space is located a neatly fitting helical tubular coil with spaced helixes to define a helical pathway between adjacent coil helixes working fluid passes through the tubular coil and process fluid passes through helical pathway to effect heat exchange between working and process fluid.

Another U.S. patent related to heat exchanger is U.S. Pat. No. 5,379,832 which is made up of a shell having a coaxial tubular outer and inner wall with end plates attached thereto to enclose a tubular shell cavity provided with an inlet and outlet for a first fluid. Within the shell cavity is a spiral coil of tubing through which flows a second fluid. The coil is wound helically about the axis of the shell and sized to fit the inner and outer walls with limited radial clearance. The coil are axially spaced from one another to define a spiral flow path within the shell cavity for the fluids to first flow. The radial and axial clearance establish a spiral flow path and an axial flow path which are relatively sized to cause the first fluid to travel in a spiral motion, thereby enhancing heat transfer between the first and second fluids. Also an enclosed central receiver include communication with the shell cavity may be formed within the inner tubular wall which serves as a fluid accumulator or reservoir.

OBJECTIVES OF THE INVENTION

It is an objective of the invention to make the cleaning of the exchanger easy. When designing the exchanger, the "dirty" fluid should be on the shell side of the unit. The innovative heat exchanger makes shell side cleaning easy. Cleaning can be done in-place, without breaking shell side or tube side pipe connections.

Further objective of the invention is to accommodate large temperature differentials particularly in cryogenic applications. The unique tube coil of the heat exchanger can easily accommodate the large temperature differentials that are typical in cryogenic units. This often uses cryogenic fluids as the cooling medium; alternately, this can be used to vaporize fluids, such as $N_2$, $O_2$, $CO_2$, or other fluids.

Another objective is to design a heat exchanger which could withstand high pressure without leakage. The tube side of the heat exchanger does not rely on gaskets for sealing, and can be designed to 15,000 psig. A key advantage this innovative heat exchanger offers is that it has no flat-sided pressure bearing surfaces that quickly becomes thick as design pressure increases. The shell side of the unit can be rated for pressures up to 5,000 psig.

Another objective is to meet the requirement of clean, chemical-free steam. This technology has been developed over the past 60 years to take advantage of the coiled tube geometry. The stacked tube layout eliminates problems caused by thermal expansion and cycling. In addition, this design promotes nucleate boiling, resulting in superior heat transfer efficiency.

Boiler blowdown and process sample coolers are perfect applications for this type of heat exchanger. The compact size of the exchanger fits into tight spaces. Also, the design can withstand the cyclic nature of blowdown service.

When natural gas is passed through a pressure reducing station, it decreases in temperature. This compact heat exchanger design can be used to increase the temperature of the natural gas.

Vent condensers are often used on storage tanks to reclaim products contained in the tank and control the harmful emissions that escape from the tank to atmosphere. During the day, the sun heats the fluid in the tank. The increase in the system's temperature will cause the vapors in the tank to expand and increase vaporization of the volatile components as their vapor pressures increase. By installing a vent condenser on the vessel, the condensable vapors are reclaimed and refluxed back into the storage tank. In addition to the venting caused by temperature changes, vapors are exhausted to atmosphere as the tank is filled. The vent condenser experiences the greatest thermal duty when the tank is being filled. The heat exchanger, therefore, should be sized based on the filling case. These units can be used to recover valuable product and reduce the load on downstream pollution control equipment at the same time.

This heat exchanger would be excellent for seal cooling applications. Keeping the mechanical seal faces cool is extremely important in extending the operating life of mechanical seals. The unique design of the heat exchanger facilitates superior cooling of the seal flush fluid as compared to traditional mechanical seal coolers. These heat exchanger seal coolers can be fitted with vent connections, which enable the units to meet the venting and draining requirements. In addition, these seal coolers have the ability to thermosiphon in the event of a pumping ring failure.

This type of heat exchanger is preferred for high-pressure service, and is often used as inter and aftercoolers to cool the gases handled by reciprocating type compressors.

Supercritical water oxidation (SCWO) is a cutting edge technology that has been developed for the treatment of hazardous waste solutions which could use the present invention. This method uses high pressure, high temperature water at its supercritical state of 3200 psig and 705 degrees F. During this process, oxygen and the supercritical water are injected into the waste stream. The waste contaminants are oxidized, transforming them into carbon dioxide and other harmless substances. This process is cost competitive and more environmentally friendly than traditional disposal methods, such as landfill or incineration.

Yet another objective of the present invention is to save energy as heat recovery economizers. Waste heat is recovered and utilized to preheat incoming make-up water, which is used in boilers or for other applications.

Present invention can provide a specially designed heat exchanger for use when handling lethal liquids or vapors. These units can be built to strict manufacturing, welding, and quality control specifications and include specially developed features to provide confidence when handling lethal fluids.

This heat exchanger design can be used to provide a compact vaporizer. The coiled tube bundle promotes nucleate boiling, and can easily handle the stresses caused by thermal expansion and cycling. Steam or other high temperature sources are often used to vaporize nitrogen, oxygen, carbon dioxide, hydrogen, methane, ethylene, various hydrocarbons, and many other fluids. Vaporizing can be achieved either shell side or tube side according to process requirements.

The compact footprint of the heat exchanger, along with its ability to handle frequent cycling and wide temperature differentials make this unit ideal for use in sample cooler applications.

Units can be provided to heat water using steam or high temperature hot water (or other fluids) as the energy source. When control of the water temperature is important, temperature control valves are often used with the heat exchanger design.

A benefit of this exchanger at higher temperatures is the ability of the coil to flex as it is heated. As the tubes are heated, they grow due to thermal expansion. Because the tube bundle is free to move, the units can undergo many years of cyclic operation without problem. A major drawback for many other types of exchangers is reduced operating life when working at higher temperatures, or the exchanger must include expensive expansion joints.

Freeze condensers fall into two categories; the first includes vapors that condense, and then freeze in the heat exchanger. The second category typically includes nonfreezing condensable mixed with water vapor or another component, which does freeze. Both applications are similar in that the objective is to condense and remove from the vent stream as much of the vapor component as possible. The most effective method is to cool the vapor below its freezing point, however, once a component begins to freeze, the heat transfer rate is gradually decreased. To obtain the best efficiency, often two parallel units are used. One unit operates, while the other undergoes a thaw cycle.

The coiled tube geometry of the heat exchanger provides increased heat transfer efficiency, making these units ideal for use as oil coolers.

Yet another objective of the present invention is to provide a heat exchanger for use in Boil-Medical area of Coiled membranes blood oxygenators Kidney dialysis devices and reverse osmosis units due to their effectiveness in reducing concentration polarization It could find use in chemical reactors due to increased residence time and minimized axial dispersion, bio-sensors, chromatographic columns, Sample coolers etc.

The present invention provides a baffle and metallic tube for a heat exchanger for transferring heat from one fluid to another fluid with, at least one bank of the metallic tube continuously formed into successive helically wound coils, each coil having at least four turns about an axis, the axis of each coil being at an angle of about 90° to each next of the successive coils.

BRIEF DESCRIPTION OF THE ACCOMPANYING DRAWINGS

FIG. 1 is a schematic of tube coil axes

Figure 2:
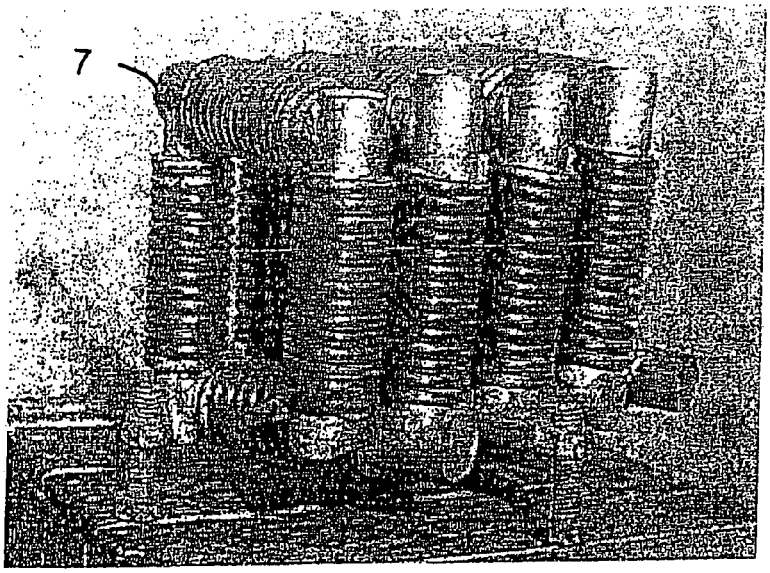

FIG. 2 pictorially shows a 4-bank, 16-coil embodiment

Figure 3:
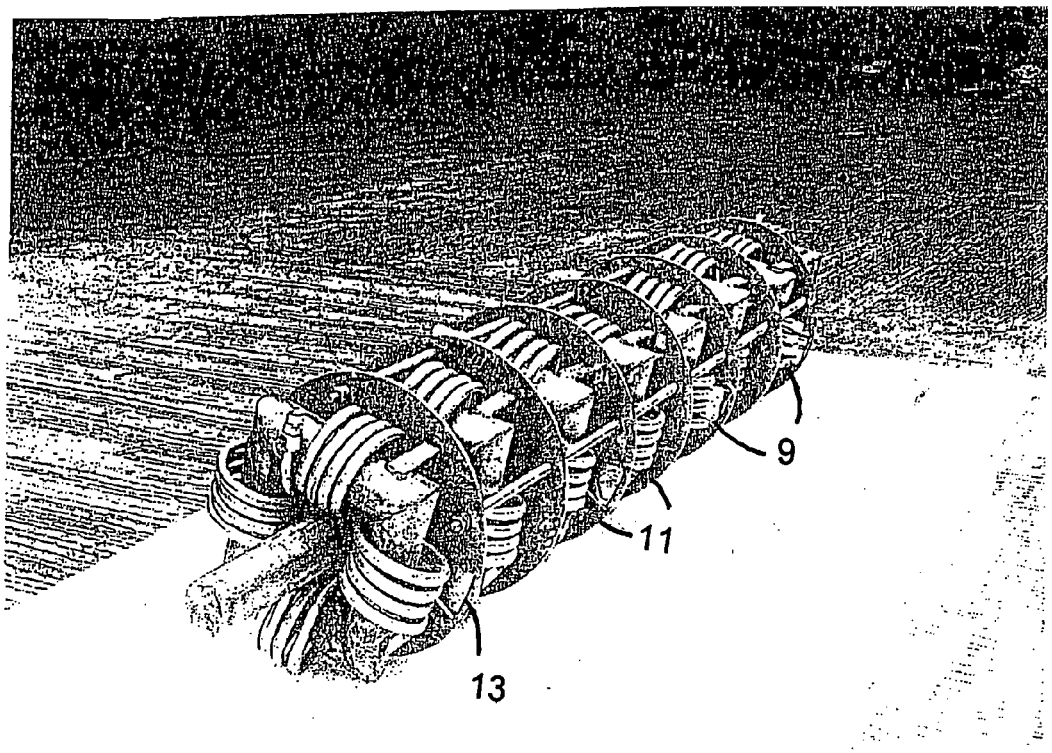

FIG. 3 pictorially shows a 7-bank, 28-coil embodiment with baffles

Figure 4:
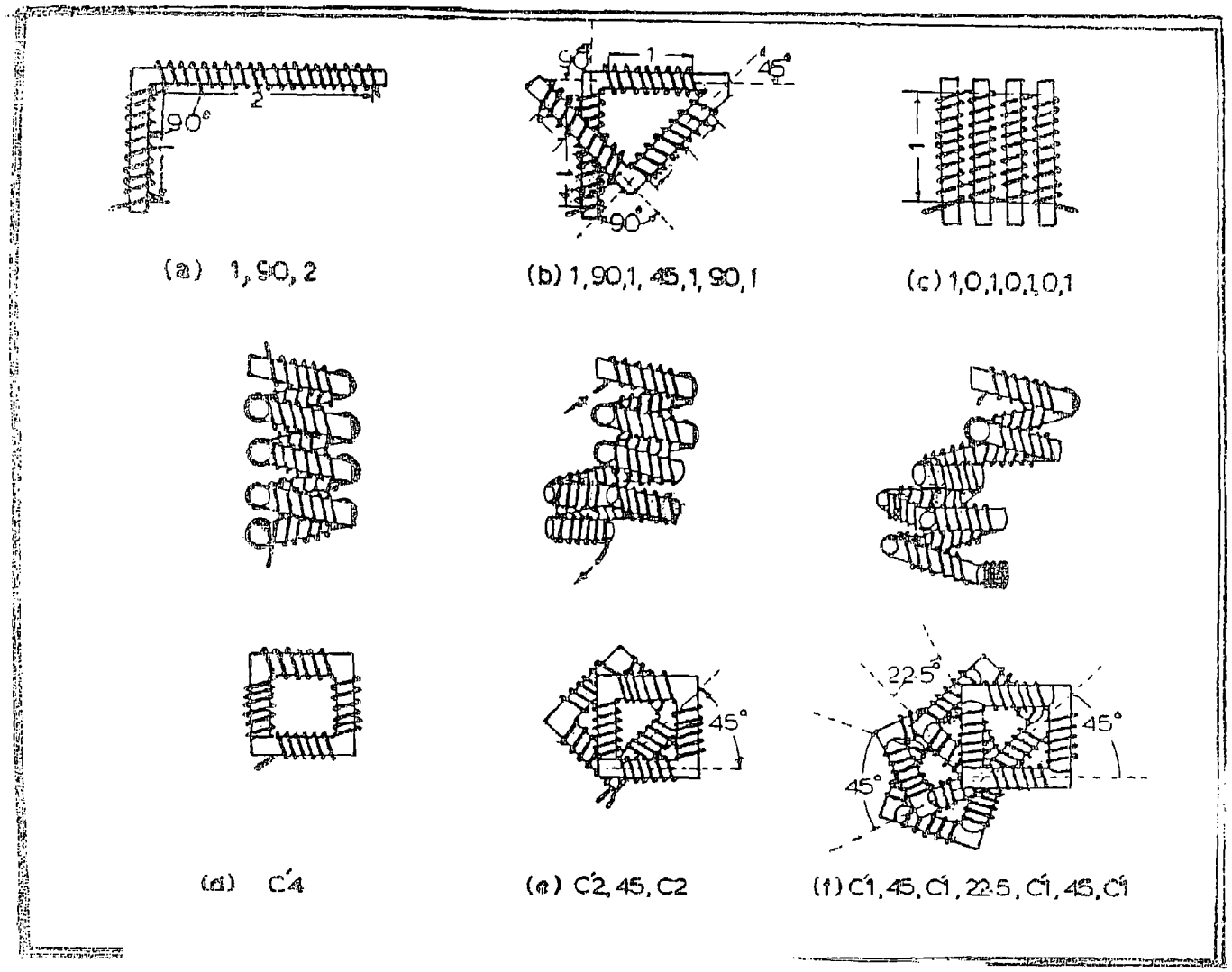

FIG. 4 Typical examples of the tube-side of Innovative Heat Exchanger

Figure 5:
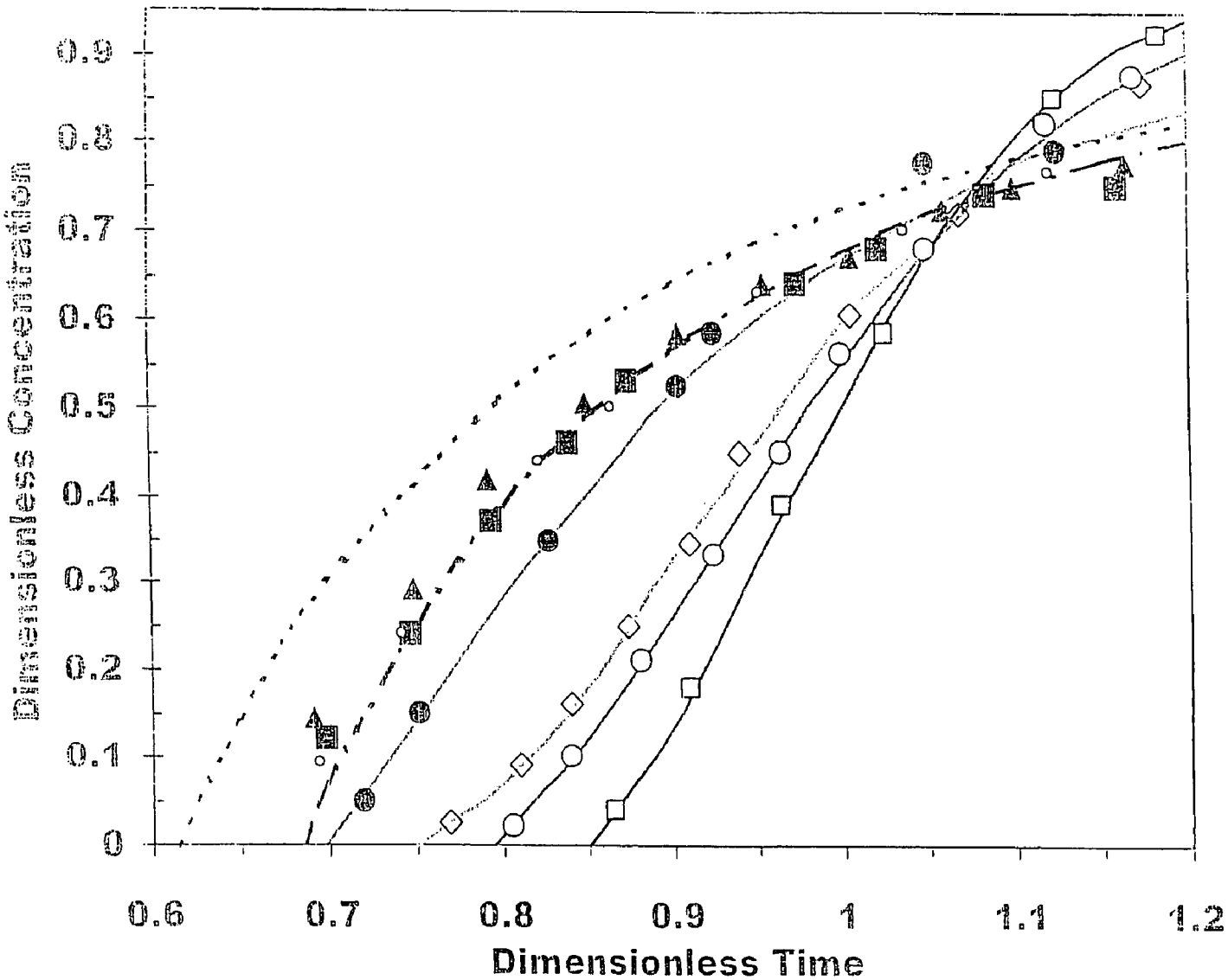

FIG. 5 Effect of number of bends on diffusion free RTD

Figure 6:
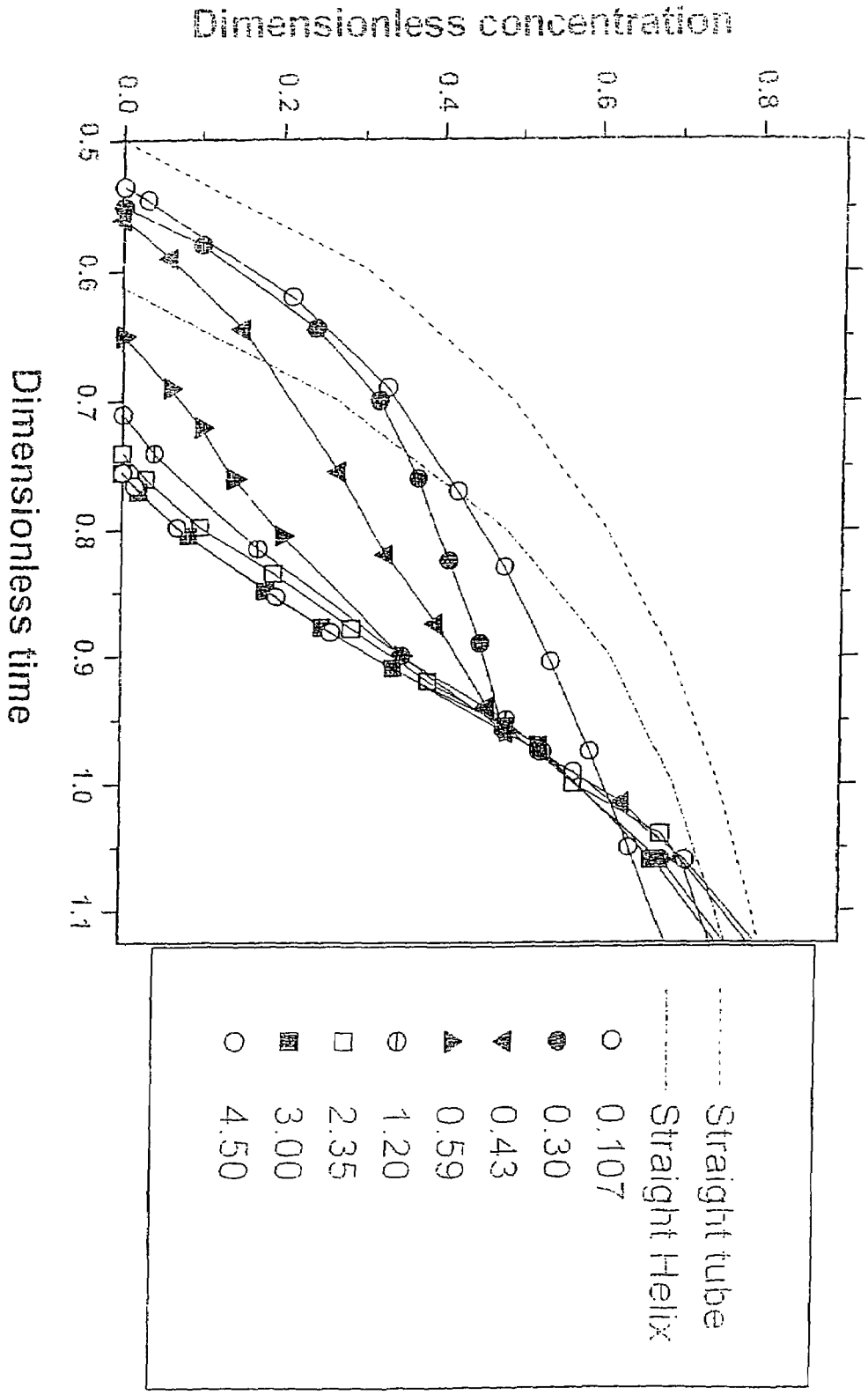

FIG. 6 Effect of Dean numbers on diffusion free RTD

Figure 7:
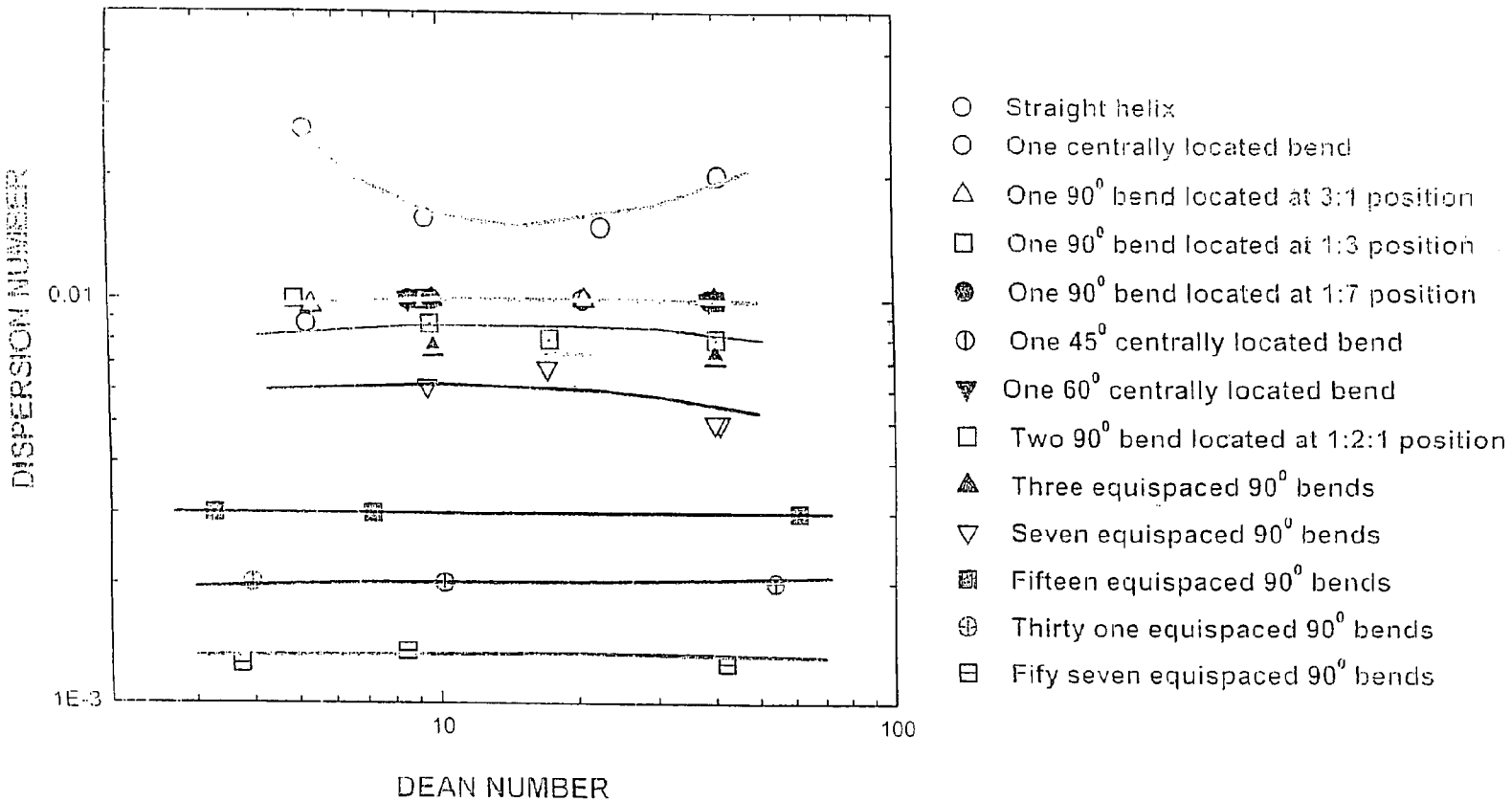

FIG. 7 Effect of Dean numbers on Dispersion numbers

Figure 8:
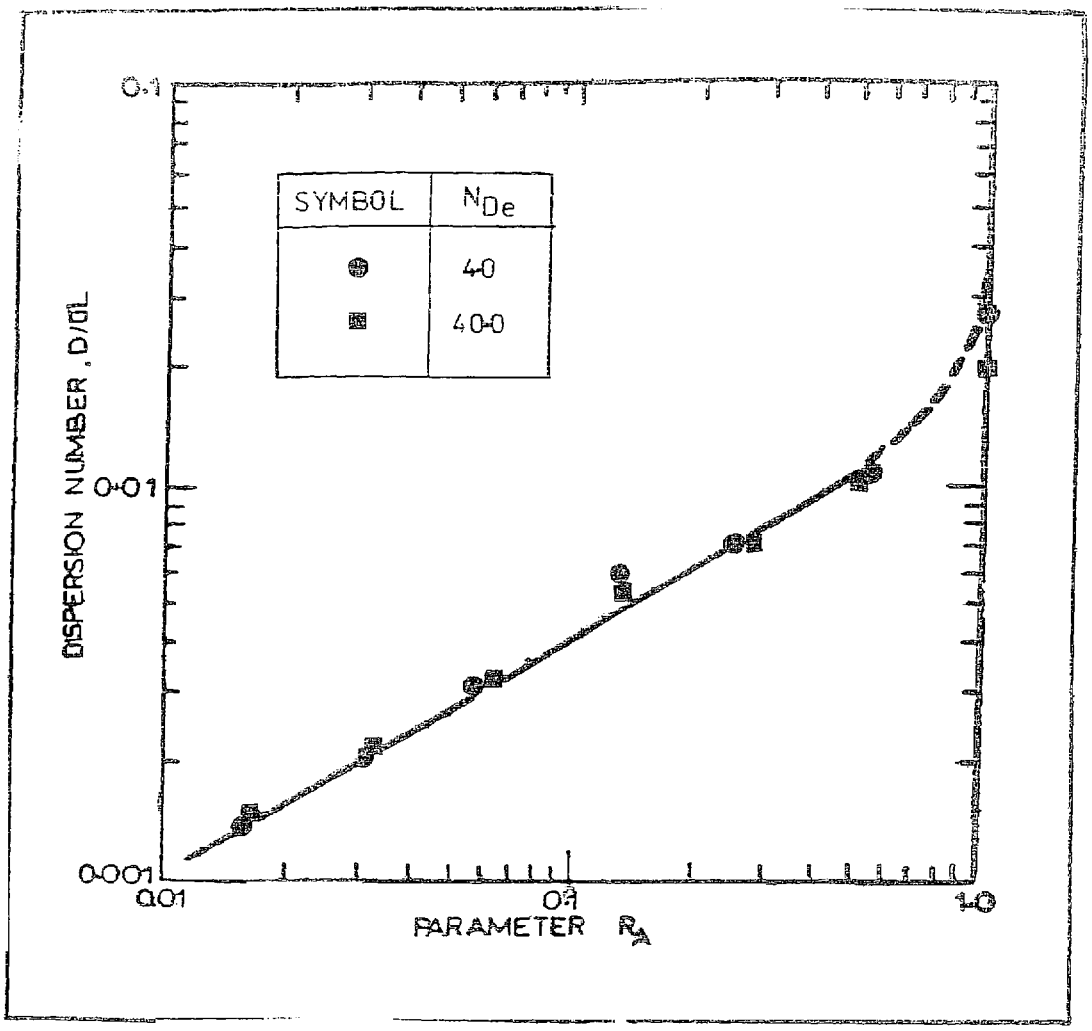

FIG. 8 Dispersion number vs. Ra

Figure 9:
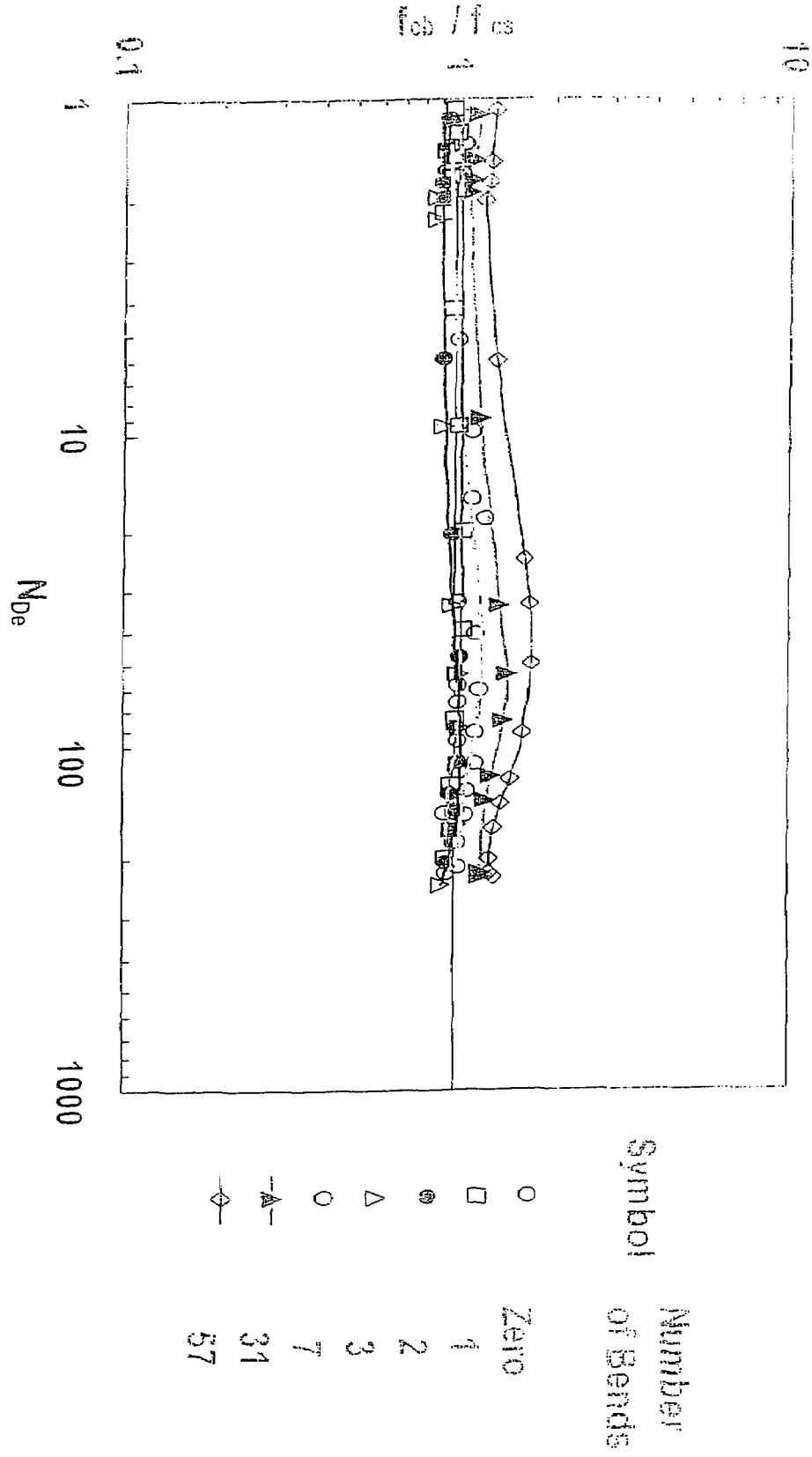

FIG. 9 Effect of number of bends on Friction factor

Figure 10:
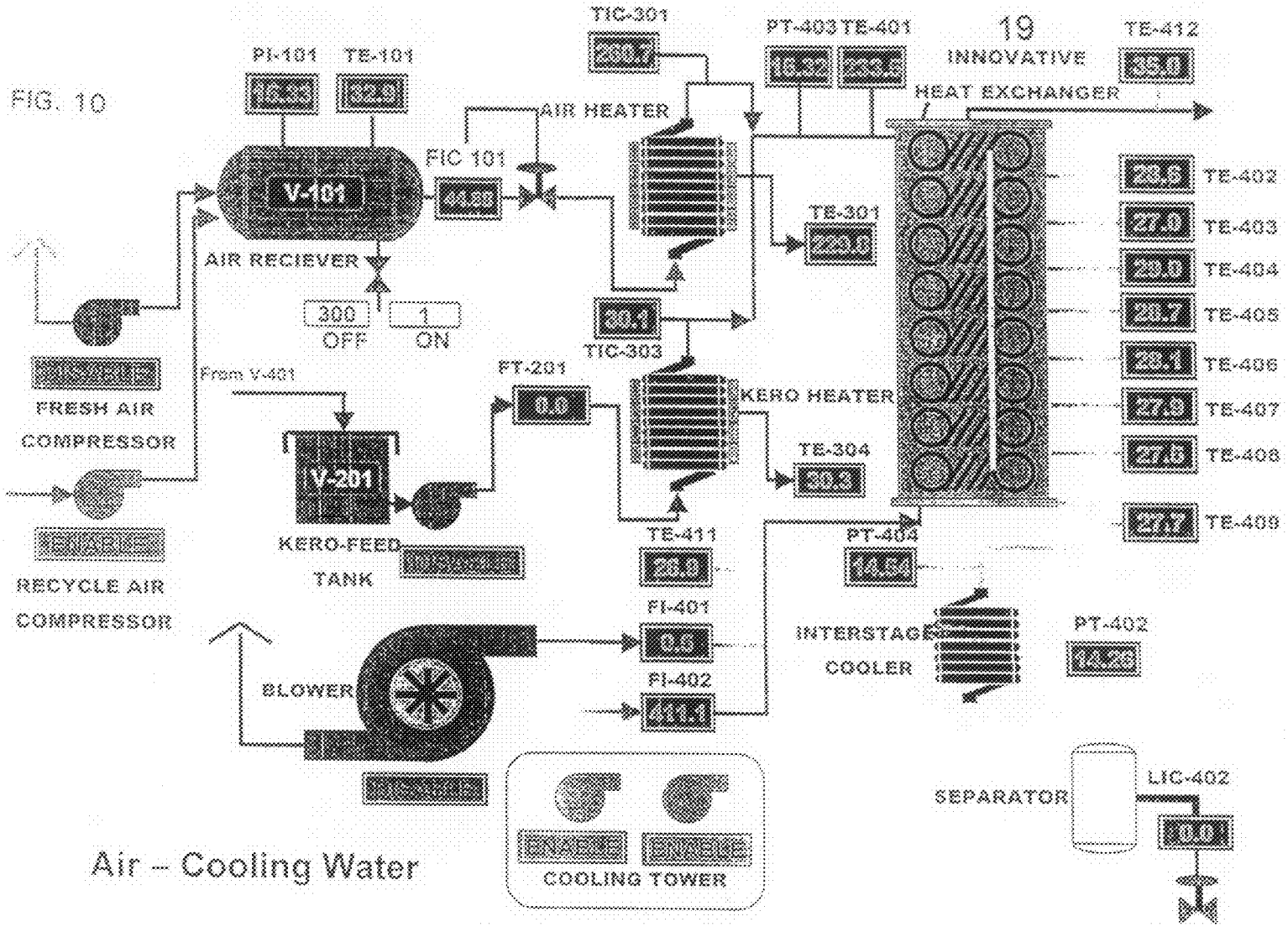

FIG. 10 Working of Innovative Heat Exchanger

DESCRIPTION OF THE INVENTION

The high performance of the present heat exchanger is a consequence of secondary flow in cross-sectional plane induced due to the difference in centrifugal force experienced by different elements of fluids being at different axial velocities. Other important effects of secondary flow are higher axial pressure gradient, diametrical pressure gradient, significant peripheral distributions of transfer rates and higher critical Reynolds number for transition to turbulent flow.

In continuous flow systems, involving concentration gradients, the material moves under the combined influence of convective transport and molecular diffusion. The performance of such flow reactors has been largely characterized on the basic of axial dispersion. This phenomenon of spread of an injected matter in axial direction, for Newtonian laminar helical flow has been theoretically studied by number of investigators[1-6]. Their analysis is essentially based on combining two aspects. The first dealing with velocity profile originating with the work of Dean[7,8] and the second on the solution of convective diffusion equation originating with the pioneering work of Taylor[9] for straight tube. Experimental Studies[10,11] on residence time distribution (RTD) for diffusion free laminar flow in coils supported the theoretical results[2,3] while under the conditions of strong molecular diffusion[12] a considerable amount of discrepancy from analytical results[1,5] has been observed. It, therefore, stresses the need of providing more reliable experimental data on "axial dispersion with strong molecular diffusion" in flow situations where no information is available.

The use of coiled flow reactors has been suggested for continuous fermentation and polymerization reactions. In most of these situations the flow is viscous and non-Newtonian in nature. The Shear dependent Viscosity of non-Newtonian fluid brings about a change of the flow pattern and therefore of the residence time distribution (RTD) within the reactor. The knowledge of RTD is essential for designing and predicting the performance of coiled reactors for such flow systems. In spite of its importance most of the studies on axial dispersion in coiled tubes have been confined to Newtonian laminar flow. The objective of the present study is to provide useful and necessary information on axial dispersion in various helical flow situations of practical importance. Apart from providing the information on deviation from ideal plug flow condition, in above mentioned flow situations, the present study also introduces a new-coiled configuration to achieve flow closer to ideal plug flow that too at low Dean numbers. In the proposed device the concept of centrifugal force in helical flow has been effectively utilized to create radial mixing in cross-sectional plane. Its performance has been characterized by measuring extend of axial dispersion, deploying step response experiments Over the years, many systems have been developed to provide the energy required to achieve the desired thermal treatments, each method having its own advantages and limitations. A coiled tube heat exchanger appeared to be the most suitable for thermal processes. Coiled or curved tubes are often used for heat transfer in mixing, storage and reactor vessel and as well as in heat exchangers owing to advantages of high heat transfer area; high heat and mass transfer coefficient and low residence time distribution (RTD). The reason for such wide use of curved tubes is many fold. As against straight tube, coiled tubes make it possible to house process equipments such as heat exchangers in very small space.

Comparing the characteristics of a coiled tube with a straight tube, it is found that the increase in the Nusselt number is much more than the increase in pressure drop. In coiled or curved tubes heat transfer will takes place not only by diffusion but also by convection. This convective heat transfer is more or less dominating depending upon the flow conditions and fluid properties. For this means it is useful in practical application and on extensive literature reviewed by Shah and Joshi[30] and Nandakumar and Masliyah[31] is available.

In coils, as with the velocity profiles, the secondary flow distorts the temperature profiles, pushing the temperature peaks towards the outer wall, which results in a higher heat transfer rate at the coil outer wall than at the inner wall. Increasing Dean number augments secondary flow while increasing Prandtl number augments thermal convection.

If a temperature distribution is present, buoyancy effects can also induce flow. At low Reynolds numbers, this natural convection effect is predominant in the secondary flow, depending upon the physical properties and the difference between the wall and the bulk temperatures. The varying gravitational force due to difference in density causes the motion of fluid in the vertical direction. If the fluid near the wall is heated, the colder, heavier fluid at the center of pipe moves towards the bottom and the fluid at the bottom returns to the top along the tube wall. This effect forces the secondary flow into two vertical vortices, the line of symmetry being a vertical line.

Several researchers attempted successfully to develop numerical methods and verified their results with the known experimental results. The heat transfer relations as given by the various authors show diversity in form even in the case of same boundary conditions, which leads to significant differences in heat transfer coefficients calculated with these relations, especially in case of high Prandtl and Reynolds numbers.

Techniques commonly used to enhance mixing often involve the generation of turbulent flow. In some cases, however, fluids with long molecular chains can be damaged by high shear stresses, and also energy is lost by turbulent agitation. In the regular laminar regime, mixing is induced mainly by molecular diffusion. The idea of generating a spatial (Lagrangian) chaotic behavior from a deterministic flow by simple geometrical perturbations has attracted much attention in recent years.

It is always required to achieve uniform reaction conditions and weaker temperature gradients within the fluid to improve the performance of flow reactors and heat exchangers. Commercial motionless mixers and flow inverters are some available mechanical devices used in industry to enhance heat transfer coefficient and provide a more uniform thermal and compositional environment. Such devices are usually effective in eliminating severe temperature and composition gradients, but have very high capital costs and high pumping costs as compared to open duct. The experimental data of Nigam and Vasudeva[71] show that the improvement caused by motionless mixers is not as significant as may be intuitively expected and building a reactor of this complexity does not appear practical. Nauman[3] has introduced a comparatively economical alternate to motionless mixers, called flow inverters, which may be installed midway or at more locations and are separated by relatively long lengths of open pipe. His analysis shows about 25 to 30% improvement in Nusselt number even with a single inverter installed midway in a heat exchanger for Graetz parameter above 10.

The experimental studies reported so far on coiled tube reveal that very high numbers are required in order to have enough mixing in cross-sectional planes and in case of motionless mixers the pumping cost is very high as compared to narrowing the RTD. In coils Dean number being the only parameter; it is practically difficult to narrow the RTD beyond a certain limit. This is because for a coil of fixed curvature ratio (i) as the Dean number is increased, Volume of the helical coil should be more in order to maintain certain residence time, which increases initial cost; and (ii) to maintain higher Dean numbers, flow rate should be more, which tends to increase the operating cost.

To overcome these problems a very simple and economical alternative "bending of helical coils" has been developed, which is very efficient in inverting the flow and improving the mixing in cross-sectional plane.

Now at any stage in helical flow if we change the direction of centrifugal force by any angle, the plane of vortex formation also rotates with the same angle. If this rotation is by the angle of 90°, the points at which apparent axial velocity was maximum before changing the direction of centrifugal force are now lying on the streamline which corresponds to the least axial velocity and new points of maximum velocity are induced on the streamline, which was at the lowest axial velocity before. Thus, in helical flow a 90 degree rotation in the direction of centrifugal force induces a complete flow inversion.

The direction of centrifugal force is always perpendicular to the axis of the coil as shown by arrows 1 in FIG. 1. Hence, it can be changed by any angle just by bending the axes of the successive helical tube coils 3, 5 with the same angle. FIG. 1 shows a 90° shift in the direction of centrifugal force. FIG. 2 pictorially shows at 7 the 90° shift for four successive tube coils of substantially one diameter in four banks for carrying a first fluid inside a shell (not shown) containing a second fluid. The axes of the four coils in each bank are in substantially the same plane. FIG. 3 pictorially shows at 9 seven similar banks of four successive coils, the banks 9 being separated by baffle plates 11 of circular shape at least one of which has a wedge shaped cut along a radial direction.

In view of the inversion of flow induced by a sharp band of 90°, it was also of interest to observe the effect if, instead of a sudden shift in the direction of centrifugal force, the plane of vortex formation is gradually rotated. This gradual rotation in the direction of centrifugal force can be obtained simply by coiling a helical coil over a cylindrical base. The effect of these two aspects on mixing in cross-sectional plane was investigated by Saxena and Nigam[66] by measuring residence time distribution In bent coils and coiled coils.

For this study, the heat exchanger was designed is shown in FIG. 3, where each bend is rotated by 90° with respect to the neighboring one. Heat exchanger is composed of 31 bends with the inside diameter (10.2 mm), the wall thickness (1.2 mm) The aspect ratio D/d of the coils is 10 and the total unfolded length is 44.4 m.

Up to three bends the geometry of coiled flow inverters is defined as $H_1$, $\delta_1$, $H_2$, $\delta_2$, $H_3$, $\delta_3$, $H_4$. Where $H_i$ (i=1, 2,3,4) is the arm proportion of ith arm and $\delta_j$ (i=1,2,3, and j=i−1) is angle between jth and j+1 th arm.

In FIG. 4A, coiled flow inverter label 1, 90, 2 implies a coil having two arms attached to each other at an angle of 90°. Proportion in the length (or value) of first and second arm is 1:2. FIG. 4. B has three bends and four equal arms. The angle between first and second arm is 90°. The third arm is attached to the second at an angle of 45° in another plane and the fourth arm to the third arm at an angle of 90°. In the coiled flow inverter of FIG. 4C, 1,0,1,0,1,0,1 represents four parallel equal arms.

In FIGS. 4D to 4G, the geometry is defined in terms of cycle. By one cycle (C'1) is meant a square formed by helix arms, i.e., C'1=1, 90, 1, 90, 1, 90, 1. If such m cycles are attached to each other such that angles between last and first arms of two consecutive cycles are 90° and planes of all the cycles are parallel, the geometry is represented by C'm. The term $C'm_1$, $\delta_1$, $C'm_2$, $\delta_2$, . . . $C'm_{i-1}$, $\delta_{i-1}$, $C'm_i$ which represents I sets of m1, m2, . . . , mi cycles attached to each other so that the angles between the arms connecting two consecutive cycles are $\delta_1$, $\delta_2$, . . . , $\delta_{i-1}$ degrees, respectively.

The following parameters may affect the performance of bent coils:

Number of bends (N);

Volume ratio of each arm to the total volume of bent coil;

Angle between different arms of helix (?); and

Dean number ($N_{De}$).

Effect of these parameters on step response curve was studied under the conditions of negligible molecular diffusion and significantly molecular diffusion.

FIG. 5 shows the effect of equispaced 90° bends on diffusion free RTD in bent coils. It can be seen from the figure that for more than 3 bends an increase in number of bends drastically narrows that RTD and for the coil of 57 bends the dimensionless time, at which the first element of the fluid appears at the outlet is as high as 0.85.

FIG. 6 shows the effect of Dean number on diffusion-free RTD in a typical coiled flow inverter (bent coil) having 15 bends of 90° each (C'4). The gradual narrowing of RTD with increase in Dean number is evident from the figure. It is worth mentioning that in the case of bent coils the unique RTD is obtained at $N_{De}$=3, which is higher as compared to $N_{De}$=1.5 reported for straight helix. This may be because of the fact that in bent coils the narrowing of RTD is caused by two mechanisms: development of secondary flow in each arm of the helix that is fully developed for $N_{De}$=1.5; and interchange of velocities among the fluid elements of different ages due to the shift in the direction of centrifugal force. Therefore, for the increase in Dean number above 1.5 the first mechanism is not effecting the RTD, but the second effect is causing more efficient shifting at the bends to further narrow the RTD and is growing up to $N_{De}$=3. this argument is supported by the experimental results shown in FIG. 6, which reveal that for the range of Dean number $0.1<N_{De}<1.2$ where both the mechanisms are likely to grow with increase in Dean number, the rate of narrowing is much faster as compared to that in the range $1.2<N_{De}<3$, where only a second mechanism is active.

Another interesting point worth noting in FIG. 6 is that unlike the straight helix, the narrowing of RTD with increase in Dean number (>0.1) starts from a point a which corresponds to Ø=1, i.e., fluid elements flowing with approximately average axial velocity. This is probably because the narrowing of RTD is caused by mixing of fluid elements of different ages at each bend. At very low Dean number (~0.1) where the secondary flow is very weakly developed, mixing will take place only among those fluid elements falling on such streamlines that have enough secondary momentum, before as well as after the bend, to induce mixing. For very weakly developed secondary flow these streamlines cannot be close to K=3.67 as well as K=∞, naturally these will be for which Ø=1.

This aspect has been experimentally examined in bent coils having inversions of first, second, and third orders. It was observed that for the fully developed secondary flow ($N_{De}$~3) the inversions of higher order have very marginal effect on the narrowing of RTD while in case of weakly developed secondary flow ($N_{De}$~1) its effect is quite substantial.

So far the effect of sudden shift in direction of centrifugal force on the mixing of fluid elements of different age groups has been discussed. Saxena and Nigam[66] have also studied the effect of gradual change in the direction of centrifugal force in two coiled coils of different $\lambda_{cc}$ and identical $\lambda_c$ curvatures. They concluded that the sudden shift in the direction of centrifugal force (Bent Coils) is more effective in narrowing the RTD than the gradual change.

Under the condition of significant molecular diffusion the effect of different parameters on axial dispersion was investigated. The range of Reynolds number was varied from 10 to 200, which corresponds to a Dean number of 30 to 60. The numbers of equispaced bends were changed from 0 to 57. They[78] analyzed the experimental data using Taylor's[9] dispersion model. The observed values of D/uL are plotted against the Dean number in FIG. 7. It is evident from the figure that in coiled flow inverters the dispersion number is independent of Dean number. It is interesting to mention that about twenty-fold reduction in dispersion number as compared to a straight helix can be obtained in a coil having 57 equispaced bends of 90 each. The experimentally obtained values of dispersion number were correlated to the design parameter RA as shown in FIG. 8 and can be written as $$\frac{D}{uL} = 0.016R_A^{0.58} \text{ For } 30 \le N_{De} \le 60 \text{ and } R_A = 0.5$$

where $R_A$=1/(N+1) (for odd number equispace bends).

Pressure drop experiments were carried out by Saxana and Nigam[66] in coiled flow inverters to assess the cost of the improvement in mixing in terms of pumping energy. The ratio of observed friction factor in bend coils ($f_{cb}$) to that in straight coils ($f_{cs}$)[79] is plotted against Dean number in FIG. 9 which reveals that as the number of bends (N) are increased, surprisingly there is a reduction in friction factor up to two bends and then it starts increasing. The probable reason for this unexpected behavior may be influence of two factors that should affect the pressure drop in coiled flow inverters:

Dissipation of energy due to the mixing in fluid elements of different ages at different bends Viscous forces that depend upon the axial velocity gradient in tube cross section.

The first factor should increase the pressure drop with increase in number of bends while the second one tends to reduce it owing to the weaker velocity gradients caused by interchange of velocities at the bends. When the number of bends is less (N ? 3), the first factor is less effective, but the second one is showing its substantial effect due to significant narrowing of RTD even with single 90° bend, causing a reduction in pressure drop. As the number of bends is increased (N>3), the influence of first factor becomes dominating, which enhances the pressure drop. It can be seen from FIG. 9, that maximum enhancement in friction factor due to bending of coils (with 57 bends) is about 1.7 fold at $N_{De}$=35. The reduction in axial dispersion is equally significant even for $N_{De}$=3 for which friction factor is only about 1.3 times higher.

Thus, low pressure drop, compactness, easy fabrication, and narrower RTD in case of coiled flow inverter establish its superiority over any other mechanical device known in literature for inducing mixing in cross-sectional plane and making flow closer to plug flow.

Now one preferred embodiment (innovative heat exchanger 19) of the present invention is explained with reference to FIG. 10.

FIG. 10 shows the working of the heat exchanger under test. The test facility is composed of a primary hot loop and a secondary cold loop. The coil under test is immersed in a cylindrically closed shell. The axis of the coil is vertical and the fluid is preheated before entering into the test section (the primary fluid). The hot loop is further divided into two sections liquid section and compressed gas section. The liquid section consists of a liquid storage vessel (SS-316) (1), a pump capable of flow rates from 30 to 300 1/min, and an inline electric resistance preheater (40° C. to 180° C.). The flow rate is measured by a bank of calibrated flow meters. Before entering into the test section the fluid is preheated up to 170° C. After passing through the heat exchanger, the fluid is cooled to ambient conditions using an inline cooler returning to the liquid vessel. The outlet temperature of the preheater is regulated by an automatic PID regulator. The compressed air section consists of a two stage air cooled fresh air compressor (21 CFM, 35 Bar g), a recycle air compressor (suction pressure 34 barg, discharge pressure 40 barg and 150 $NM^3$), and an inline electric resistance preheater (40° C. to 250° C.). When the system is operating in laminar flow regime the fresh air compressor will work and the recycle air compressor will be switched off, and when the system is operated in the turbulent flow regime the recycle air compressor will be operated and fresh air compressor will be switched off.

The cold loop, is further divided into two sections: cooling water section and ambient air section. The cooling water section consists of a cooling tower and ambient air section consists of a blower of 500 $m^3$/hr capacity. When the system is operated with cooling water, blower is kept switched off, and when the unit is operated with blower, cooling tower will be switched off.

A cooler and a gas-liquid separator will be followed by heat exchanger unit. Cooler is used for cooling the fluid from the outlet of the heat exchanger to the ambient conditions, then it is recycled back to the storage vessel. Gas-liquid separator vessel is also used as the pressure regulator. For the thermal measurement, iron-constantan thermocouples are used at the different bends of the coiled flow inverter, so as to get the better understanding of the results, especially the temperature profiles. Two thermocouples are attached at the inlet and outlet of the shell side fluid.

Standard material choices for the heat exchanger include copper tubes with a cast iron shell, however, a variety of different materials can be provided specific to area of application

EXAMPLES WITH LIST OF TABLES

Table 1. Working Fluids

Table 2. Data analysis of water-air system

Table 3. Data analysis of air-water system

Table 4. Data analysis of air-air system

Table 5. Data analysis of water-water system

For the single phase experiments systems and ranges for flow rates, pressure and temperatures are given below:

TABLE 1

| Process Conditions | | | | |
|---|---|---|---|---|
| Fluid | | Flow rate | Pressure | Temperature |
| Tube | Shell | Lit/hr | $Kg_f/cm^2$ | ° C. |
| Kerosene | Cooling water | 30-300 | 1-5 | 40-150 |
| Kerosene | Ambient air | 30-300 | 1-5 | 40-150 |
| Compressed air | Cooling water | 0.1-4.0 | 1-35 | 40-220 |
| Compressed air | Ambient air | 0.1-4.0 | 1-35 | 40-220 |

For the calculations necessary to study and characterize the heat exchangers, the physical properties of the fluids must be known. The physical properties were evaluated at the mean fluid temperature, $(T_{outlet}+T_{inlet})/2$:

In developing relationships between the heat-transfer rate, surface area, fluid terminal temperatures, and flow rates in the heat exchangers, the basic equations are the energy conservation and rate equations. There are four alternative methods for heat-transfer analysis: the efficiency-NTU, the thermal performance coefficient-NTU, the logarithmic mean temperature difference and the heat flux-thermal performance coefficient method. The second method is selected here, for the heat exchanger that takes into account the thermal performance and the pressure losses of the heat exchanger. That is why it is necessary to calculate an overall coefficient that represents the thermal performance of the heat exchanger.

TABLE 2

Data Analysis of Water-Air System

Properties of Fluids

| System | Tube | Shell |
|---|---|---|
| Fluid | DM Water | Air |
| Density at 40 C. (kg/cm$^3$) | 995 | 1.19 |
| Viscosity (kg/m · s) | 0.0008 | 1.79E−05 |
| Heat capacity (Kj/Kg · ° C.) | 4.186 | 1.009 |
| Thermal Conductivity (W/m · ° C.) | 0.6 | 0.6 |

| | Flow rate Kg/hr | Tin ° C. | Tout ° C. | Pin kg/cm$^2$ | Pout kg/cm$^2$ | Pressure Diff kg/cm$^2$ |
|---|---|---|---|---|---|---|
| Tube | 99.5 | 117.10 | 61.8 | 2.58 | 2.55 | 0.03 |
| Shell | 890 | 44.70 | 68.3 | | | |
| LMTD(° C.) | | 27.34 | | | | |
| Energy balance (W) | Tube 6398.01 | | | | | |
| | Shell 5886.95 | | | | | |

Overall Heat transfer Coefficient based on inner tube area

| | |
|---|---|
| Ui (W/m$^2$ · C.) | 165.48 |

Overall Heat transfer Coefficient based on outer tube area

| | |
|---|---|
| Uo (W/m$^2$ · C.) | 132.90 |

Friction factor Calculation

| | |
|---|---|
| Velocity (m/s) | 0.34 |
| NRe | 4312.74 |
| Wall shear stress (Pa) | 0.17 |
| Cf | 0.0030 |

TABLE 3

Data Analysis of Air-Water System

Properties of Fluids

| System | | Tube | Shell |
|---|---|---|---|
| Fluid | | Comp. Air | Cooling water |
| Density at 40 C. | kg/cm$^3$ | 10.98 | 995 |
| viscosity | kg/m · s | 2.58E−05 | 0.0008 |
| Heat capacity | Kj/Kg · ° C. | 1.009 | 4.186 |
| Thermal Conductivity | W/m · ° C. | 0.0242 | 0.6 |

| | Flow rate Kg/hr | Tin ° C. | Tout ° C. | Pin kg/cm$^2$ | Pout kg/cm$^2$ | Pressure Diff kg/cm$^2$ |
|---|---|---|---|---|---|---|
| Tube | 67 | 230.00 | 28 | 15.31 | 13.64 | 1.67 |
| Shell | 650 | 27.50 | 32.8 | | | |
| LMTD | | 32.91 | ° C. | | | |
| Energy balance | Tube | 3793.28 | W | | | |
| | Shell | 4005.77 | W | | | |

Overall Heat transfer Coefficient based on inner tube area

| | |
|---|---|
| Ui | 81.51 W/m$^2$ · C. |

Overall Heat transfer Coefficient based on outer tube area

| | |
|---|---|
| Uo | 65.46 W/m$^2$ · C. |

Friction factor Calculation

| | | |
|---|---|---|
| velocity | 20.74 | m/s |
| NRe | 90048.27 | |
| wall shear stress | 9.65 | Pa |
| Cf | 0.0041 | |

TABLE 4

Data Analysis of Air-Air System

Properties of Fluids

| System | | Tube | Shell |
|---|---|---|---|
| Fluid | | Comp. Air | Cooling water |
| Density at 40 C. | kg/cm$^3$ | 21.85 | 21.85 |
| viscosity | kg/m · s | 2.62E−05 | 2.62E−05 |
| Heat capacity | Kj/Kg · ° C. | 1.009 | 1.009 |
| Thermal Conductivity | W/m · ° C. | 0.0242 | 0.0242 |

| | Flow rate Kg/hr | Tin ° C. | Tout ° C. | Pin kg/cm$^2$ | Pout kg/cm$^2$ | Pr. Diff kg/cm$^2$ |
|---|---|---|---|---|---|---|
| Tube | 130 | 198.40 | 45.7 | 29.82 | 26.44 | 3.38 |
| Shell | 856 | 44.40 | 68 | | | |
| LMTD | | 28.02 | ° C. | | | |
| Energy balance | Tube | 5563.79 | W | | | |
| | Shell | 5662.06 | W | | | |

Overall Heat transfer Coefficient based on inner tube area

| | |
|---|---|
| Ui | 140.43 W/m$^2$ · C. |

Overall Heat transfer Coefficient based on outer tube area

| | |
|---|---|
| Uo | 112.79 W/m$^2$ · C |

Friction factor Calculation

| | | |
|---|---|---|
| velocity | 20.23 | m/s |
| NRe | 172053.03 | |
| wall shear stress | 19.53 | Pa |
| Cf | 0.0044 | |

TABLE 5

Data Analysis of Water-Water System

Properties of Fluids

| System | | Tube | Shell |
|---|---|---|---|
| Fluid | | Comp. Air | Cooling water |
| Density at 40 C. | kg/cm$^3$ | 995 | 995 |
| viscosity | kg/m · s | 0.0008 | 0.0008 |
| Heat capacity | Kj/Kg · ° C. | 4.186 | 4.186 |
| Thermal Conductivity | W/m · ° C. | 0.6 | 0.6 |

| | Flow rate Kg/hr | Tin ° C. | Tout ° C. | Pin kg/cm$^2$ | Pout kg/cm$^2$ | Pressure Diff kg/cm$^2$ |
|---|---|---|---|---|---|---|
| Tube | 232 | 106.70 | 37.1 | 2.52 | 2.23 | 0.29 |
| Shell | 1360 | 35.80 | 47.8 | | | |
| LMTD | | 15.10 | ° C. | | | |
| Energy balance | Tube | 18775.61 | W | | | |
| | Shell | 18976.53 | W | | | |

Overall Heat transfer Coefficient based on inner tube area

| | |
|---|---|
| Ui | 878.99 W/m$^2$ · C. |

Overall Heat transfer Coefficient based on outer tube area

| | |
|---|---|
| Uo | 705.96 W/m$^2$ · C. |

Friction factor Calculation

| | | |
|---|---|---|
| velocity | 0.79 | m/s |
| NRe | 10055.84 | |
| wall shear stress | 1.68 | Pa |
| Cf | 0.0054 | |

While particular embodiments of the present invention have been illustrated and described, it would be obvious to those skilled in art that various other changes and modifications can be made without departing from the spirity and scope of the invention. It is therefore intended to cover in the appended claims all such changes and modifications that are within the scope of this invention.

I claim:

1. In a heat exchanger for transferring heat between a first fluid and a second fluid, the improvements comprising:

at least one bank of metallic tube for the first fluid continuously formed into at least two successive helically wound coils of substantially one diameter, each of the coils having at least four turns about an axis, the axis of each of the coils being at an angle of about 90° to the axis of a next successive of the coils.

2. The heat exchanger as claimed in claim 1, further comprising a further bank separated from the one bank by a baffle plate to regulate flow of the second fluid in a shell thereabout.

3. The heat exchanger as claimed in claim 2, wherein the baffle plate is circular in shape with a wedge shaped cut along a radial direction.

4. The heat exchanger as claimed in claim 1, wherein axes of the coils of the bank form substantially a square shape.

5. The heat exchanger as claimed in claim 1, wherein said coil is made of stainless steel.

6. The heat exchanger as claimed in claim 1, wherein the coils accommodate flow rate of 30-300 1/hr for liquids and 20-125 kg/hr for gases.

7. The heat exchanger as claimed in claim 1, wherein the coils withstand pressure up to 40 $kg/cm^2$ (gauge).

8. The heat exchanger as claimed in claim 1, wherein the axes of the coils are substantially in a common plane.

9. The heat exchanger as claimed in claim 1, wherein the axes of the coils are in at least two planes.

10. The heat exchanger as claimed in claim 1, wherein there are more than four coils in the bank.

11. The heat exchanger as claimed in claim 1, wherein there are twelve coils in the bank with axes each at an angle of 90° in a common plane.

12. The heat exchanger as claimed in claim 11, wherein there is only one bank.

13. The heat exchanger as claimed in claim 1, wherein there is only one bank.

14. The heat exchanger as claimed in claim 1, wherein a ratio of the diameter of the coils to a diameter of the tube is at least 10:1.

* * * * *